350-6.5 SR

XR 4,042,933

1X 350/6.5

United States

Lapp

4,042,933

Aug. 16, 1977

[54] ANTENNA LINE SCAN SYSTEM FOR HELICOPTER WIRE DETECTION

[75] Inventor: Roger H. Lapp, Silver Spring, Md.

[73] Assignee: The United States of America as represented by the Secretary of the Navy, Washington, D.C.

[21] Appl. No.: 668,776

[22] Filed: Mar. 19, 1976

[51] Int. Cl.[2] ..... H01Q 3/12; H01Q 19/18

[52] U.S. Cl. ..... 343/761; 343/766; 343/781 P; 350/7

[58] Field of Search ..... 350/6, 7; 343/761, 839, 343/766, 781 P

[56] References Cited

U.S. PATENT DOCUMENTS

| | | | |
|---|---|---|---|
| 3,516,722 | 6/1970 | Pusch | 350/6 |
| 3,619,028 | 11/1971 | Keene et al. | 350/7 |
| 3,866,233 | 2/1975 | Schmidt | 343/781 CA |

*Primary Examiner*—Eli Lieberman

[57] ABSTRACT

The present invention relates to a scanning system comprising a three element reflecting antenna, wherein two of the reflecting elements synchronously counter rotate about axes other than their optical axes in order to generate a linear scan.

12 Claims, 15 Drawing Figures

REFLECTORS OUT
OF PHASE

REFLECTORS PHASED
PROPERLY

FIG. 11
TILTED COMPONENT ARRANGEMENT (NEGATIVE)
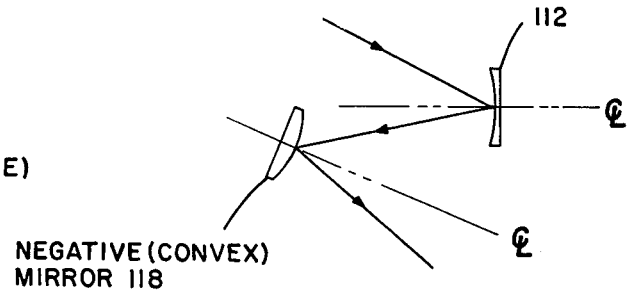
FIG. 12
TILTED COMPONENT ARRANGEMENT (POSITIVE)
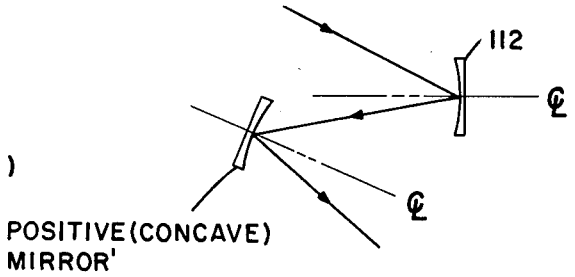
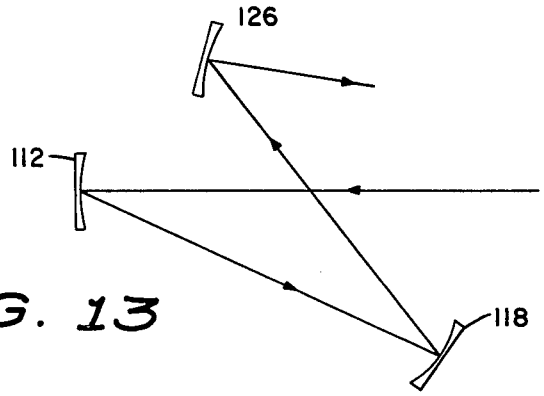
FIG. 13
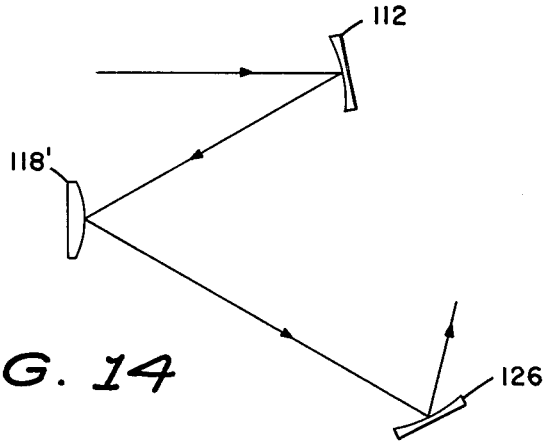
FIG. 14

ANTENNA LINE SCAN SYSTEM FOR HELICOPTER WIRE DETECTION

SUMMARY OF THE INVENTION

The use of optical principles in the design of radar scan systems is not new to the art. Flying spot scanners, for example, which have a single rotating mirror, such as that found in U.S. Pat. No. 3,793,637, have employed optical principles like reflection for radar beam direction control. However, such systems have been limited to sector, rather than line, scanning and have been susceptible to great losses of power and resolution.

The present invention satisfies a well-known, long-felt need in both civilian and military areas by providing a line-scanning radar apparatus with high resolution, which does not have the aforementioned disadvantages.

The present invention is low cost, light weight and small, and has the potential for high data rate reception.

Many prior art line scanning antennas have included mechanisms which sweep in one direction, stop, and sweep in the reverse direction. The inertial limits suffered and the scan speed constraints imposed by such start-stop techniques have greatly limited the accuracy and versatility of such prior art radar scanners. The present invention, by achieving a line scan by rotating rather than oscillating masses, has no practical scan speed constraints or inertial limits.

The above-described features make the present invention particularly significant in a helicopter wire-detection, nape-of-the-earth radar apparatus for collision avoidance, where the line scanning is vertical with high vertical resolution.

BRIEF DESCRIPTION OF THE DRAWINGS

FIG. 3 illustrates the results of equal, matched reflection effects during proper operation.

FIG. 4 illustrates a defective scan resulting from unequal reflection effects of unmatched reflectors and tilt angles;

FIGS. 11, 12, 13 and 14 are diagrams illustrating known optical telescope configurations which may be adapted for use in the radar application of the present invention. Each configuration, when properly rotated with appropriate tilt angles as shown in FIG. 1, represents an alternative embodiment of the invention.

DESCRIPTION OF THE INVENTION

Figure 2:
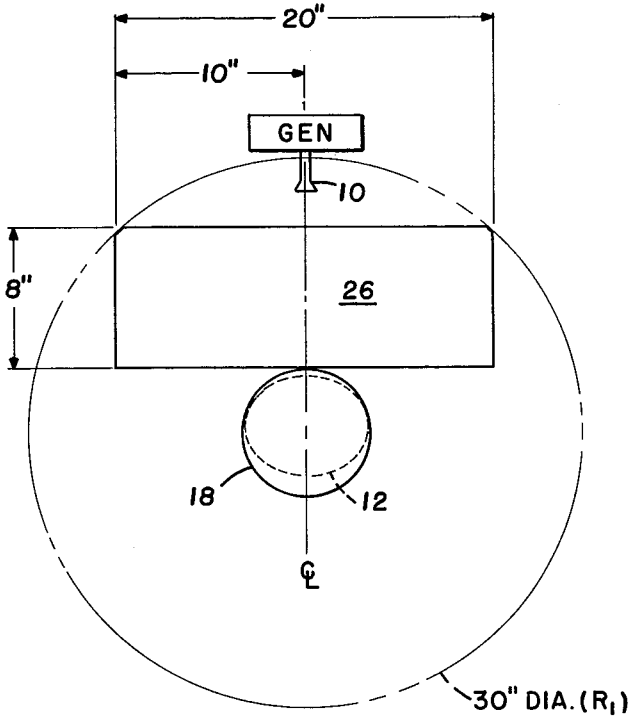
FIG. 2 is a front view of the invention showing dimensions for the embodiment shown in FIG. 1.
Figure 1:
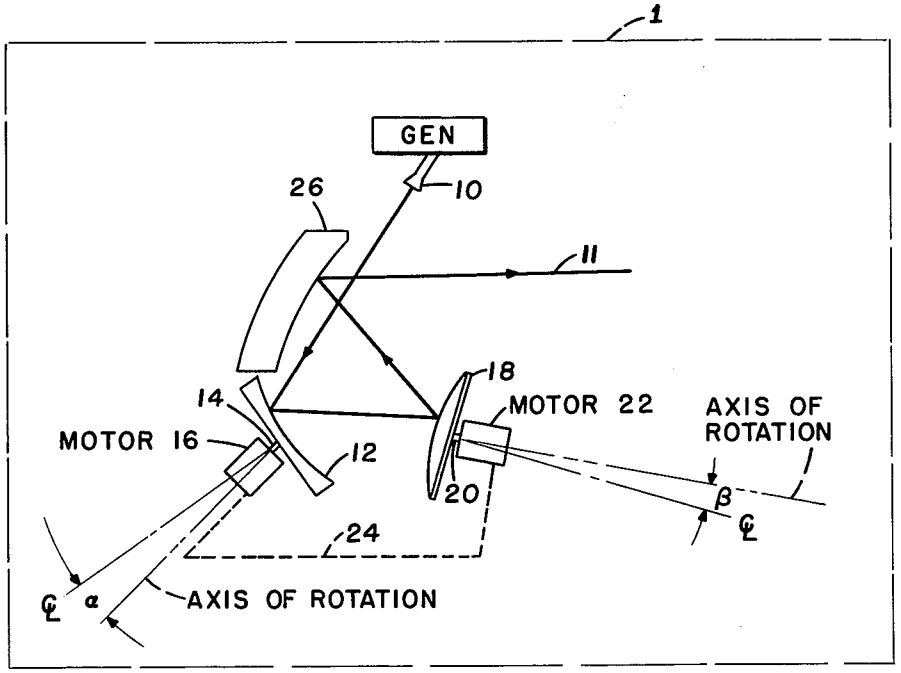
FIG. 1 is a side view diagram showing the elements in the present invention.

Referring to FIG. 1, RF power is generated by a power generator (GEN) into a feed horn 10. In the preferred embodiment, the RF is generated at the Extremely High Frequency of 95 Gigahertz. Feed horn 10 directs the power into a radar ray 11 which reflects off a tertiary curved reflector 12 (which includes a positive, negative, or flat reflector). In FIG. 1 and FIG. 2 feed horn 10 is located at the effective focus of the reflector system. Although various geometrically defined designs of reflectors could be implemented, as suggested in *Technical Report* 68 (1971) of the University of Arizona Optical Science Center by Richard Buchroeder, a preferred embodiment would be defined as follows. Primary reflector 26 represents a portion cut away from a parabolic reflector with a 30 inches diameter, where its surface is defined by the equation $Y^2 = 40X$; the surface of secondary reflector 18 is defined with an eccentricity $e = 1.363$; and tertiary reflector 12 is weak spherical and is chosen positive or negative to place generator 10 as close as possible without shadowing ray 11. The separation between the primary reflector 26 and secondary reflector 18 at paraxial points is 8 inches. Tertiary curved reflector 12 is affixed to the shaft 14 of a motor 16. The optical centerline (℄) of tertiary curved reflector 12 forms a tilt angle $\alpha$ with the axis of rotation of shaft 14. This causes tertiary curved reflector 12 to rotate in a tilted fashion as motor shaft 14 rotates. The ray 11 reflecting from tertiary curved reflector 12 is reflected into a secondary curved reflector 18. In FIG. 1, tertiary curved reflector 12 is shown to be positive (i.e., the center thickness is less than the thickness at the edge) and secondary curved reflector 18 is shown negative. Secondary curved reflector 18 is also affixed to the shaft 20 of a motor 22 at a tilt angle $\beta$. Secondary curved reflector 18 and tertiary curved reflector 12 are tilted by angles $\alpha$ and $\beta$, respectively so that their synchronous counter-rotation achieves, in the embodiment of FIGS. 1 and 2 a $\pm$ 33 milliradian scan. Angles $\alpha$ and $\beta$ are also selected such that the combined effect of reflector curvature and tilt angle $\alpha$ for tertiary curved reflector 12 is equal to the combined effect of reflector curvature and tilt angle $\beta$ for the secondary curved reflector 18. That is, each outgoing reflection angle is composed of the tilt angle (of the respective reflector) plus the angle of reflection due to the reflector curvature. The outgoing reflection angles for tertiary reflector 12 and secondary reflector 18 are made effectively equal.

The rotation of shaft 14 by motor 16 causes tertiary curved reflector 12 to rotate in a tilted fashion determined by angle $\alpha$. The rotation of the shaft 20 by motor 22 causes secondary curved reflector 18 to rotate in a tilted fashion determined by the angle $\beta$ at the same speed and in-phase with, but in a direction opposite to, the rotation of tertiary curved reflector 12. To assure that motor shaft 14 and motor shaft 20 rotate in synchronism and in reverse directions (one clockwise, the other counterclockwise), a coupling 24 can be employed. Coupling 24 may be a phase-locked motor arrangement or a mechanical coupling.

Figure 3:
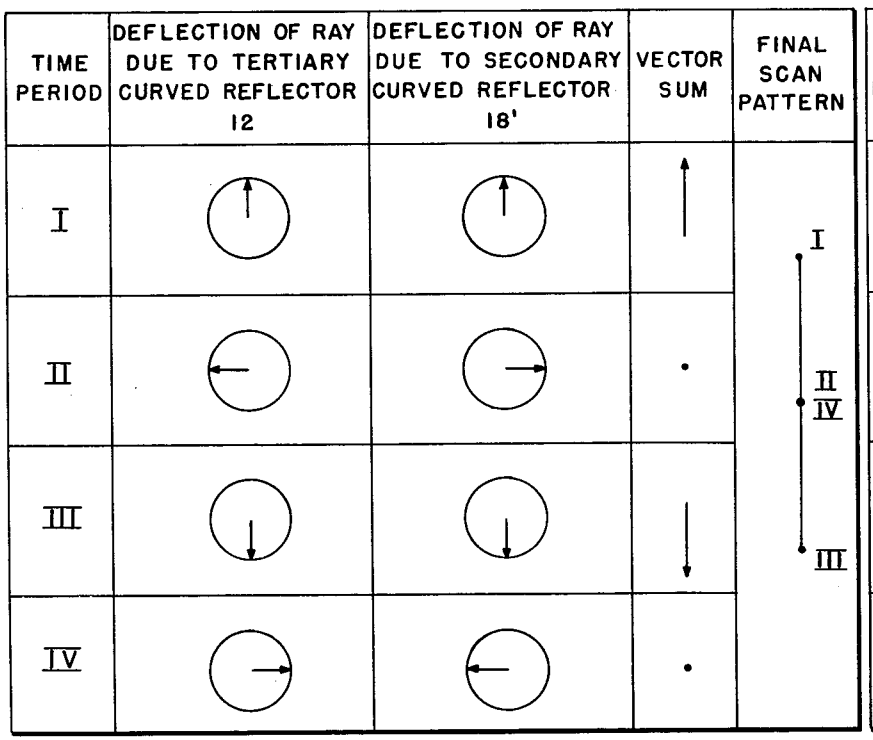
FIGS. 3 and 4 are vector diagrams showing the individual and cumulative effect of the rotating secondary and tertiary curved reflectors. The resulting scan pattern is also shown.
Figure 4:
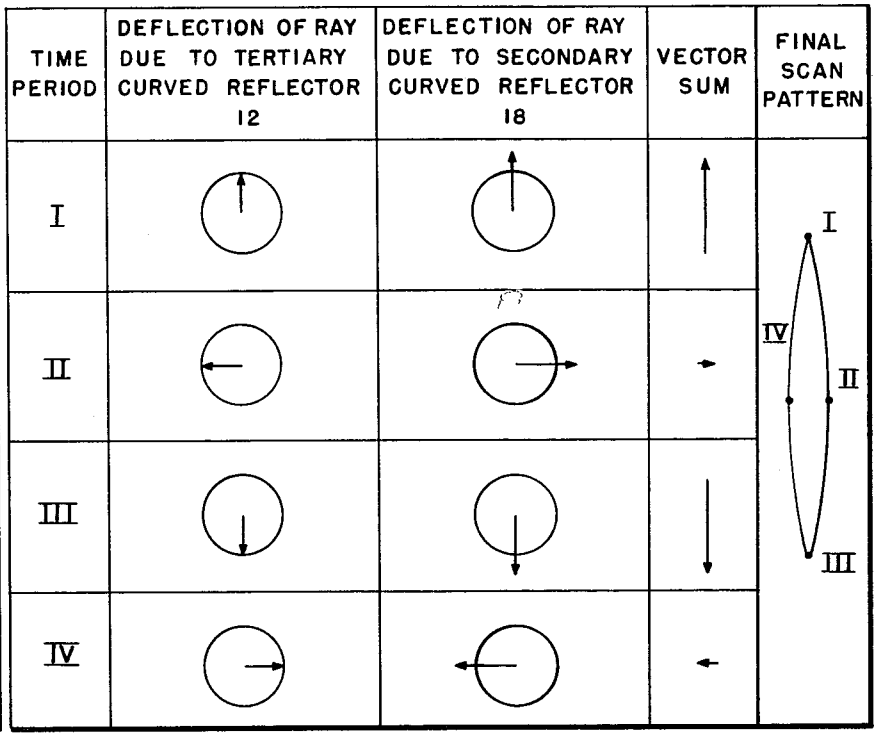
Figure 5:
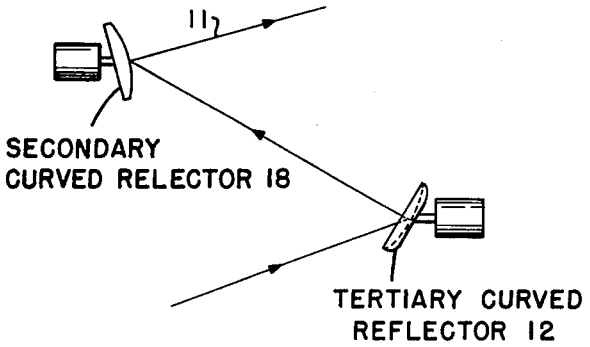
FIGS. 5 through 8 comprises four diagrams illustrating the operation of the present invention, as shown in FIG. 3, during four representative times, with emphasis on the resulting effect of the tilted rotations of the secondary curved reflector and the tertiary curved reflector.

The effect of synchronously rotating secondary curved reflector 18 and tertiary curved reflector 12 in opposite directions and with effectively equal outgoing reflection angles is shown in FIGS. 3 and 4. FIGS. 3 and 4 show in vector form, the effects of reflecting an incoming ray off the counter-rotating reflectors. In FIG. 3, the speeds of rotation are shown properly phased and the outgoing reflection angles from each reflector 12 and 18 are effectively equal. At time I, the deflection of an incoming ray due to tertiary curved reflector 12 is in the "12 o'clock" direction. In the preferred embodiment, this indicates a deflection of the reflected ray 11 in the vertical direction. The effect of secondary curved reflector 18 is to direct ray 11 equally in the 12 o'clock (or vertical) direction. The vector sum shown in the fourth column of FIG. 3 illustrates the cumulative effect of tertiary curved reflector 12 and secondary curved reflector 18.

Figure 6:
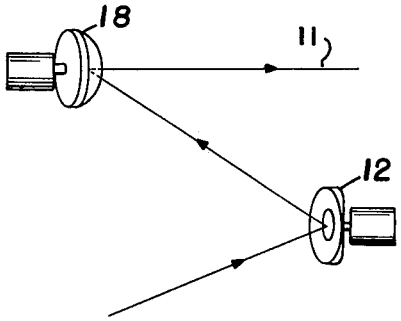
Figure 8:
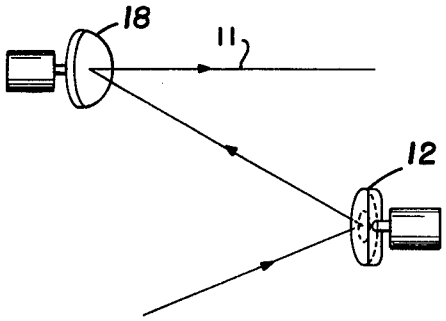
Figure 7:
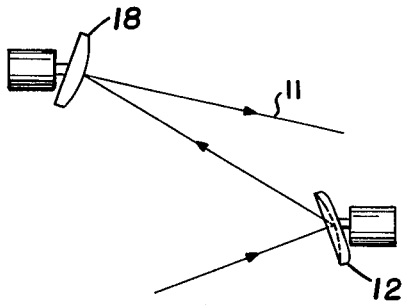

FIG. 5 through 8 illustrates, in pictorial form, the vector diagrams for sample times I, II, III, and IV showing the relative positions of reflectors 12 and 18 for each time. At time I (FIG. 5), both tertiary curved reflector 12 and secondary curved reflector 18 are tilted upward to produce a reinforced upward vertical deflection of a ray in the 12 o'clock direction. At time III (FIG. 7), tertiary curved reflector 12 and secondary curved reflector 18 are tilted downward producing a reinforced downward deflection in the 6 o'clock direction of the ray. At times II (FIG. 6) and IV (FIG. 8) tertiary curved reflector 12 and secondary curved reflector 18 are tilted oppositely in sideways directions. During times II and IV a cancellation of the effects of tertiary curved reflector 12 and secondary curved reflector 18 occurs. That is, still referring to FIG. 5, if tertiary curved reflector 12 is tilted to cause horizontal deflection of the impinging ray (in the 9 o'clock direction) out of the page, secondary curved reflector 18 is tilted to cause its maximum horizontal deflection of the impinging ray (in the 3 o'clock direction) into the page. Because tertiary curved reflector 12 and secondary curved reflector 18 have exactly equal but opposite effects they counterbalance and cancel each other in the horizontal direction (in the preferred embodiment). This effect, which is exemplified at times II and IV (as shown in FIGS. 6 and 8), is present at all times during the antenna scan, resulting in the cancellation of all horizontal (in the preferred embodiment) components of deflection.

FIG. 4 illustrates the effect of having a secondary curved reflector 18 which has a greater outgoing reflection angle than does tertiary curved reflector 12. An examination of the vector sum and resulting scan in that figure shows a residual horizontal component which prevents a perfectly vertical scan in contrast to the line scan illustrated in FIG. 3.

Although the invention includes an arrangement wherein tertiary curved reflector 12 is exactly opposite to secondary curved reflector 18, both being tilted at the same angle $\alpha$, the invention generally relates to an arrangement where the tilt angles are not the same. The magnitude of deflection caused by secondary curved reflector 18 and tertiary curved reflector 12 are made "effectively equal" by altering the shape of tertiary curved reflector 12 and/or secondary curved reflector 18 as in FIG. 1. For example, a smaller tilt angle for tertiary curved reflector 12 can be compensated for by appropriately decreasing the radius of curvature of the tertiary curved reflector 12 (if it is positive as in the FIG. 1 embodiment) or otherwise appropriately varying the structure of tertiary curved reflector 12 and/or secondary curved reflector 18. Alternatively, with given reflectors 12 and 18, tilt angles $\alpha$ and $\beta$ respectively, can be varied to produce the effectively equal result. The vital relationship between these two cooperating reflectors is that their ray outgoing reflection angles be effectively equal so as to cancel and reinforce in the desired orthogonal planes respectively as shown in FIG. 3.

At this point it should be noted that, when a bundle of rays is directed toward a curved reflector at skewed angle with respect to its optical axis, defocussing or aberration results. Some of this aberration is compensated for in the invention by maintaining large f-numbers (that is, focal length: reflector diameter ratio) for reflectors 12, 18 and 26. Also, by maintaining the angle of skew to relatively small limits, the magnitude of aberration can be decreased. In contrast to the optical telescope which is vitally concerned with focus and image clarity, the presence of residual aberration effects in radar systems is tolerable because radar seeks only pulse-no pulse returns rather than images.

Figure 9:
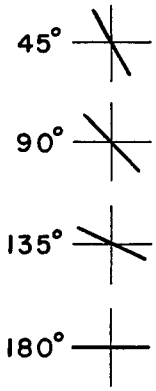
FIGS. 9 and 10 comprise a pair of sketches illustrating the effect of proper phase on the scan pattern.
Figure 10:
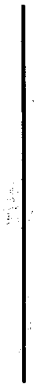

FIGS. 9 and 10 include illustrations of scan patterns which show the importance of synchronizing motors 16 and 22 to counter-rotate at the same speed in the proper phase. The scan can be disoriented, if reflectors 12 and 18 rotate out of phase and the scan will have unpredictable shapes if reflectors 12 and 18 rotate non-synchronously. The present invention contemplates the use of a coupling 24 representing a phase-locked motor arrangement in its preferred embodiment to assure synchronous, in-phase counter-rotation.

FIGS. 11 through 14 show classes of unobscured lens configurations known in the optical art which can be used as RF antennas in the present invention. Unobscured antennas reflect rays coming from a secondary curved reflector 18 off a primary disk-type reflector 26 only part of which is used such that the ray from primary reflector 26 travels out into space unobscured by any of the reflectors.

U.S. Pat. No. 3,782,835 is an example of an obscured scanning system wherein reflecting surfaces are provided with apertures so that the surfaces may pass and block (or obscure) light rays as required. The placement of a primary reflector 26 with relation to secondary curved reflector 18 and the positioning of the radar ray impinging on secondary curved reflector 18 determine the class. If primary reflector 26 and secondary curved reflector 18 do not share the same optical center line and the impinging principal ray reflects off the vertex 28 of secondary curved reflector 18 and then reflects off the vertex 30 of primary reflector 26, a tilted component arrangement results. FIGS. 11 and 12 illustrate the negative and the positive subclasses, respectively, of the tilted component telescope (TCT) optical class from which unobscured antenna arrangements of the present invention have been adapted. The subclass in FIG. 11 is generally referred to as a Schiefspiegler TCT because it has a convergent mirror objective 112 followed by a convex secondary mirror 118. The subclass shown in FIG. 12 is generally known as a Yolo TCT because it has a convergent mirror objective 112 (as in the Schiefspiegler, however) followed by a concave secondary mirror 118'. FIGS. 13 and 14 show two three-mirror (including mirrors 112, 118 or 118', and 126) tilted subclasses of the Yolo and Schiefspiegler classes, respectively. A more elaborate discussion of Yolo and Schiefspiegler TCTs is presented in *Technical Report* 68. Replacing the mirrors with EHF reflectors of proper curvature and rotating the reflectors synchronously in opposite directions, line scanning according to the invention is achieved.

Figure 15:
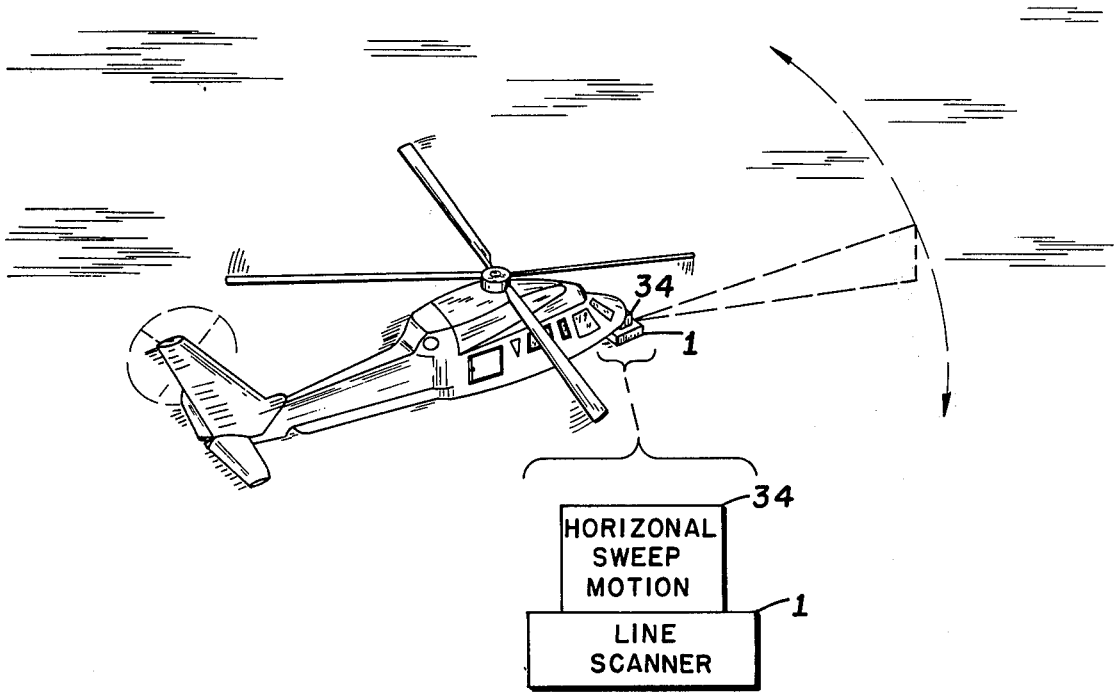
FIG. 15 is an illustration showing the present invention being employed as a helicopter wire detector.

As previously mentioned, the present invention is designed to scan in a line, in its preferred embodiment a vertical line. FIG. 15 shows the invention being employed as a helicopter wire detector. In addition to the generation of a vertical line scan by means of line scanner 1, FIG. 15 also shows the line being swept horizontally by a motor means 34, or the like.

Although the preferred embodiment contemplates the use of a primary reflector 26 which amplifies and directs the incoming ray from secondary curved reflector 18, embodiments of the present invention are also contemplated wherein primary reflector 26 may be omitted as shown in FIGS. 11 and 12. For the sake of convention, however, the labels "secondary" and "tertiary" are attached to the two essential reflectors, whether or not primary reflector 26 is present.

It should be understood that other changes and variations in the invention as embodied may be fashioned which are within the spirit and scope of the invention as contemplated and claimed.

What is claimed is:

1. A line scan antenna system comprising:

means for generating a radar ray, a tertiary curved generally spherical concave reflector positioned to receive and reflect the radar ray generated by the ray generating means, a secondary curved reflector of curvature opposite that of the tertiary curved reflector positioned to receive and reflect the rays coming from the tertiary curved reflector, and means for rotating the secondary curved reflector in a tilted fashion with respect to its optical centerline in one direction and for rotating the tertiary curved reflector in a tilted fashion with respect to its optical centerline synchronously and in phase but in the opposite direction of the secondary reflector to effect cancellation of reflection in one plane.

2. A line scan antenna system comprising:

means for generating power, a feed horn which receives the generated power and directs the power into radar rays, a tertiary curved generally spherical concave reflector positioned to receive and reflect the rays coming from the feed horn, a secondary curved reflector of curvature opposite that of the tertiary curved reflector, said secondary curved reflector being positioned to receive and reflect the rays of the tertiary curved reflector, a first motor having a shaft which is affixed to the tertiary curved reflector, where said first motor shaft and the optical centerline of the tertiary curved reflector form an angle $\alpha$ relative to one another, and a second motor having a shaft which is affixed to the secondary curved reflector, where said second motor shaft and the optical centerline of the secondary curved reflector form an angle $\beta$ relative to one another, $\alpha$ and $\beta$ being selected such that the reflection caused by said secondary curved reflector is cancelled in one dimension by an opposite reflection caused by said tertiary curved reflector.

3. A line scan antenna system as defined in claim 2 further comprising a coupling between the first motor and the second motor to synchronize their rotational speeds.

4. A line scan antenna system as defined in claim 3 wherein said coupling comprises:

a phase-lock motor coupling.

5. A line scan antenna system as defined in claim 3 further comprising:

a primary reflector positioned to receive and reflect rays from the secondary curved reflector in unobscured fashion.

6. A line scan antenna system as defined in claim 5 wherein the primary reflector and the secondary curved reflector are convex.

7. A line scan antenna system as defined in claim 5 wherein the primary reflector is convex and the secondary curved reflector is concave.

8. A method for antenna scanning in a vertical line with high unidirectional resolution, comprising the steps:

generating radar rays, transmitting the generated rays to a tertiary curved generally spherical concave reflector, reflecting the rays from the tertiary curved reflector to a secondary curved reflector of curvature opposite that of the tertiary curved reflector, reorienting the direction of the rays periodically wherein said reorientation comprises the steps:

rotating the second curved reflector and tertiary curved reflector at the same speed in opposite directions, tilting the optical centerline of the rotating second curved reflector by an angle $\alpha$ with respect to the axis of rotation of the secondary curved reflector and tilting the optical centerline of the tertiary curved reflector by an angle effectively equal to $\alpha$ with respect to the axis of rotation of the tertiary curved reflector, and reflecting the rays from the secondary curved reflection in a line scan pattern.

9. A method for radar antenna scanning as defined in claim 8, comprising the further step:

placing a primary reflector to receive the reflected ray from the secondary curved reflector and to reflect the ray in an unobscured fashion.

10. A method for antenna scanning as defined in claim 9, comprising the further step:

sweeping the line scan in a direction perpendicular to the direction of the line.

11. A method for radar antenna scanning as defined in claim 9, comprising the further step:

orienting the line of the scan pattern to be vertical wherein said vertical orientation comprises the step of positioning the tertiary curved reflector and the secondary curved reflector to achieve the cancellation of horizontal reflection.

12. A method for radar antenna scanning as defined in claim 9, comprising the further steps:

tilting the optical centerline of the secondary curved reflector to be at an angle with the optical centerline of the primary curved reflector, directing the ray coming from the tertiary curved reflector toward the vertex of the tilted secondary curved reflector, and reflecting the ray from the vertex of the tilted secondary curved reflector into the vertex of the primary curved reflector.

* * * * *